US006547178B2

(12) United States Patent
Rodriguuez

(10) Patent No.: US 6,547,178 B2
(45) Date of Patent: Apr. 15, 2003

(54) TURN-UP METHOD AND APPARATUS FOR LIGHTWEIGHT GRADES OF PAPER

(76) Inventor: Peter A. Rodriguuez, 13612 McQueens Ct., Jacksonville, FL (US) 32225

( * ) Notice: Subject to any disclaimer, the term of this patent is extended or adjusted under 35 U.S.C. 154(b) by 0 days.

(21) Appl. No.: 09/817,331

(22) Filed: Mar. 26, 2001

(65) Prior Publication Data

US 2002/0134879 A1 Sep. 26, 2002

(51) Int. Cl.[7] ..... B65H 35/08
(52) U.S. Cl. ..... 242/526.2; 242/532.3
(58) Field of Search ..... 242/526, 526.2, 242/532.3

(56) References Cited

U.S. PATENT DOCUMENTS 4,975,011 A * 12/1990 Holmberg ..... 412/6
5,453,141 A * 9/1995 Rodriguez ..... 242/526.2

FOREIGN PATENT DOCUMENTS

JP 10168404 * 6/1998

* cited by examiner

*Primary Examiner*—John Q. Nguyen
(74) *Attorney, Agent, or Firm*—Arthur G. Yeager

(57) ABSTRACT

The turn-up system for this invention consists of two basic parts:

1. A kraft substrate flat paper tape having a layer of water-activated adhesive on one side and a layer of pressure sensitive adhesive tape (PSAT) on the other side, which may or may not be protected by a releasable liner. The tape is approximately one to four inches in width. The tape is applied onto the outside of an empty reel spool (with or without a removable core) before the spool has been placed in the primary arms of the reel using the PSAT side to adhere the tape to the spool thus exposing the water-activated side of the tape to the ambient. The tape is to be applied in a single or multiple spiral pattern covering all or most of the length of the spool. After the application of the tape the reel spool should be loaded into the primary arms and moved into place as usual practice dictates. 2. Nozzles for supplying moisture to the tape wrapped reel spool before it is in the turn-up position (nip). This could employ a single or plurality of atomizing water/air or water/steam nozzles that produce a volume of water droplets suspended in an airflow that can be introduced into the boundary layer of air that is moving at synchronous speed with the upper surface of the paper web. Application of a moisture field into the web boundary layer on the top of the web insures that the moisture makes its destination at the nip and is applied directly to the empty reel spool and the water-activated adhesive it is carrying. When enough moisture is applied to the water-activated adhesive, the web will attach to the empty reel spool and simultaneously detach from the full paper roll thus producing a turn-up. Timing for application of the water spray can be controlled automatically with respect to position and/or rotational speed of the empty reel spool. Spray duration dwell, water/air mixture and velocity can be tightly controlled and easily adjusted. Steam or hot water can also be used if desired.

21 Claims, 4 Drawing Sheets

TURN-UP METHOD AND APPARATUS FOR LIGHTWEIGHT GRADES OF PAPER

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The invention relates to the apparatus and method for severing a moving web of lightweight paper and reattaching it to a new rotating reel spool.

2. Related Art

It is common practice in the paper industry to use compressed air, water or liquid adhesive singly or in combination to produce a turn-up depending on factors such as machine speed and paper grade. Such manual processes depend on timing and practice and at best produce a measure of waste paper. What is desired is an approach that does not depend upon human timing and the error and waste that is associated with it.

BRIEF SUMMARY OF THE INVENTION

In one aspect of the present invention there is provided apparatus for severing a traveling web of paper and transferring a web to an empty reel to which is attached a pressure sensitive adhesive carrying a strip of paper having a planar lower side substantially covered by the pressure sensitive adhesive and a planar upper side carrying a layer of water-activated adhesive covering substantially the entire surface of the upper side. The apparatus comprises a frame extending substantially a width of a web from one edge to another edge and selectively operable water applying means mounted to the frame for selectively wetting the water-activated adhesive on the empty reel for attachment of a web thereto and resulting in severing of a web. The water applying means includes a plurality of spaced nozzles and water supply means for selectively supplying water to each nozzle. The water-supplying means may include high-pressure air supply mean for supplying air to each nozzle for providing an atomized spray of water from each nozzle. Alternately, the water applying means includes misting means for providing a water mist onto a boundary layer of air moving on an upper surface of a web. The misting means includes water supply means for supplying water to each nozzle and may include high-pressure air means for supplying high-pressure air to each nozzle.

In another aspect of the present invention there is provided an apparatus for severing a traveling web of paper and transferring a web to an empty reel comprising a strip of paper having a planar upper side carrying a layer of water-activated adhesive for adhering to a web covering substantially the entire surface of the upper side and means for attaching the paper strip to an empty reel, a frame and selectively operable water-applying means mounted to the frame for selectively wetting the water-activated adhesive attached to an empty reel for securing a web thereto and severing of a web. The means for attaching the water-activated adhesive includes pressure sensitive adhesive underlying the paper strip. The water-supplying means may further include high-pressure air supply means for supplying air to each nozzle for providing an atomized spray of water from each nozzle. The water-applying means may also include misting means for providing a water mist onto a boundary layer of air moving on an upper surface of a web for directing water into a nip between an empty reel and a reel drum for wetting the water-activated adhesive on an empty reel. The misting means includes a plurality of spaced atomizing nozzles located generally between side edges of a web. The misting means includes water-supplying means for supplying means for supplying water to each nozzle and may include high-pressure air means for supplying high-pressure air to each nozzle.

There is also provided wetting means that includes steam applying means having a plurality of spaced nozzles and steam supply means for selectively supplying steam to each nozzle. The wetting means may also include water applying means and means for elevating the temperature of the water applied.

In a further aspect of the present invention there is provided a method for severing a traveling web of paper and transferring the web to an empty reel comprising the steps of: attaching a thin paper sheet strip via a pressure sensitive adhesive to an empty spool in which the strip on its upper surface carries an exposed water-activated adhesive substantially throughout the upper surface; mounting a plurality of spaced water-supplying nozzles generally between one edge of a web to another edge; and selectively supplying water to each nozzle mounted for wetting the water-activated adhesive. An additional step includes applying a water mist onto a boundary layer of air moving on an upper surface of a web prior to creating a nip between an empty reel and a reel drum.

Another aspect of the present invention includes apparatus for severing a traveling web of paper and transferring a web to an empty reel comprising a quantity of composite tape including a thin sheet of paper having a planar upper side and a planar lower side, a layer of water-activated adhesive covering substantially the upper side, a layer of pressure sensitive adhesive covering substantially the lower side, and a releasable liner covering the pressure sensitive adhesive. A frame extends substantially the width of a web from one edge to another edge and selectively operable water-applying means is mounted to the frame for wetting the layer of water activated adhesive when a length of the tape is attached to an empty reel by the layer of pressure sensitive adhesive to permit securing of a web to the water-activated adhesive. The water-applying means includes a plurality of spaced spray nozzles and water supply means for selectively supplying water to each spray nozzle and may include a high-pressure air supply means for supplying air to each spray nozzle for providing an atomized spray of water from each spray nozzle. The plurality of spaced spray nozzles is located across a web from one edge to another edge for wetting substantially an entire surface of the layer of water-activated adhesive. Alternately, the water-applying means may include misting means for providing a water mist onto a boundary layer of air moving on the upper surface of a web for wetting substantially an entire surface of the layer of water-activated adhesive. The misting means includes a plurality of spaced atomizing spray nozzles located on the frame and extending from one edge of a web to another edge.

A final aspect of the present invention is a package of composite tape for use in apparatus for severing a traveling web of paper and transferring a web to an empty reel, the tape including a sheet of paper having a planar upper side and a planar lower side, a layer of water-activated adhesive covering substantially the upper side, a layer of pressure sensitive adhesive covering substantially the lower side, and a releasable liner covering the pressure sensitive adhesive. The tape is adapted for use with selectively operable water-applying means for wetting the layer of water-activated adhesive when a length of the tape is attached to an empty reel by the layer of pressure sensitive adhesive to permit securing of a web to the water-activated adhesive.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description, taken in connection with the accompanying drawings, in which:

DETAILED DESCRIPTION OF THE INVENTION

INTRODUCTION

The turn-up apparatus for this invention consists of two basic parts:

1. A kraft substrate flat paper tape having a layer of water-activated adhesive on one side and a layer of pressure sensitive adhesive tape (PSAT) on the other side, which may or may not be protected by a releasable liner. The tape is approximately one to four inches in width.

The tape is applied onto the outside of an empty reel spool (with or without a removable core) before the spool has been placed in the primary arms of the reel using the PSAT side to adhere the tape to the spool thus exposing the water-activated side of the tape to the ambient. The tape is to be applied in a single or multiple spiral pattern covering all or most of the length of the spool. At this time the water-activated adhesive is dry and oblivious to the ambient "dust" that consists of loose fiber particles that is so prevalent at the dry end of a light paper or tissue machine. The dust will blind a normal adhesive and render it useless very quickly. After the application of the tape the reel spool should be loaded into the primary arms and moved into place as usual practice dictates.

2. Apparatus is also provided for supplying moisture to the tape wrapped reel spool after it is in the turn-up position. This method could employ a single or plurality of atomizing water/air nozzles that produce a volume of water droplets suspended in an airflow that can be introduced into the boundary layer of air that is moving at synchronous speed with the upper surface of the paper web. Application of a moisture field into the web boundary layer on the top of the web insures that the moisture makes its destination at the nip and is applied directly to the empty reel spool and the water-activated adhesive it is carrying.

When enough moisture is applied to the water-activated adhesive, the web will attach to the empty reel spool at the nip and simultaneously detach from the full paper roll thus producing a turn-up. The turn-up should take place quickly yielding lower levels of waste paper than conventional manual methods of turn-up. Timing for application of the water spray can be controlled automatically with respect to position and/or rotational speed of the empty reel spool. Spray duration dwell, water/air or water/steam mixture and velocity can be tightly controlled and easily adjusted.

Figure 1A:
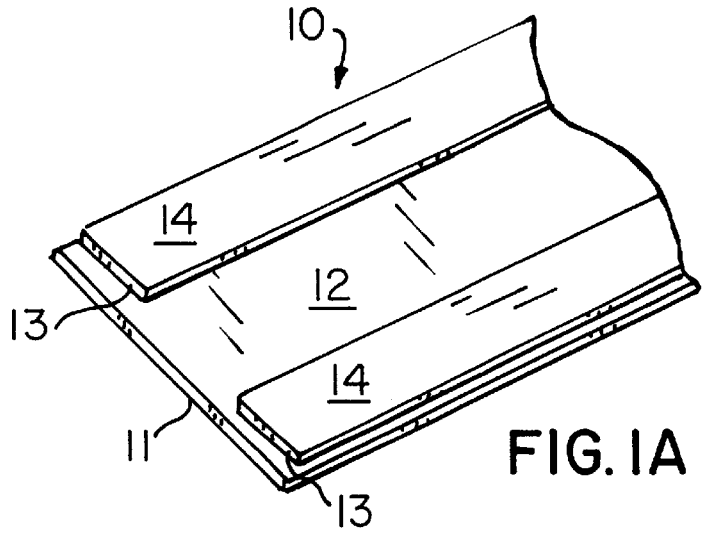
FIGS. 1A and 1B are views of a portion of the turn-up tape according to the present invention.
Figure 1B:
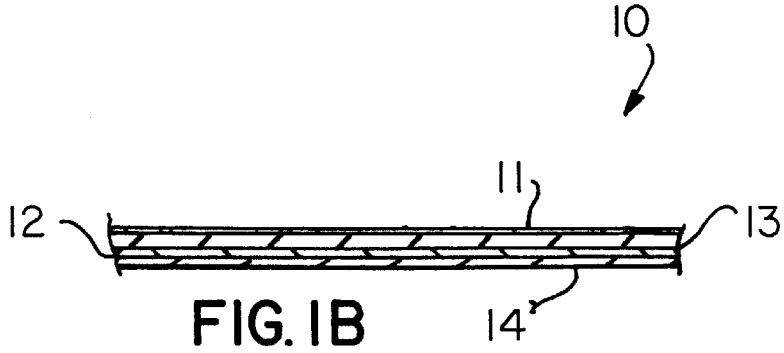

With respect now to the drawings, the turn-up tape in accord with the present invention is shown at numeral 10 in FIGS. 1A and 1B. A water-activated adhesive coating 11 rests on base paper 12, which has pressure sensitive adhesive 13 on the other side. Silicone liner 14 protects adhesive 13 from dust until ready for use.

Figure 2:
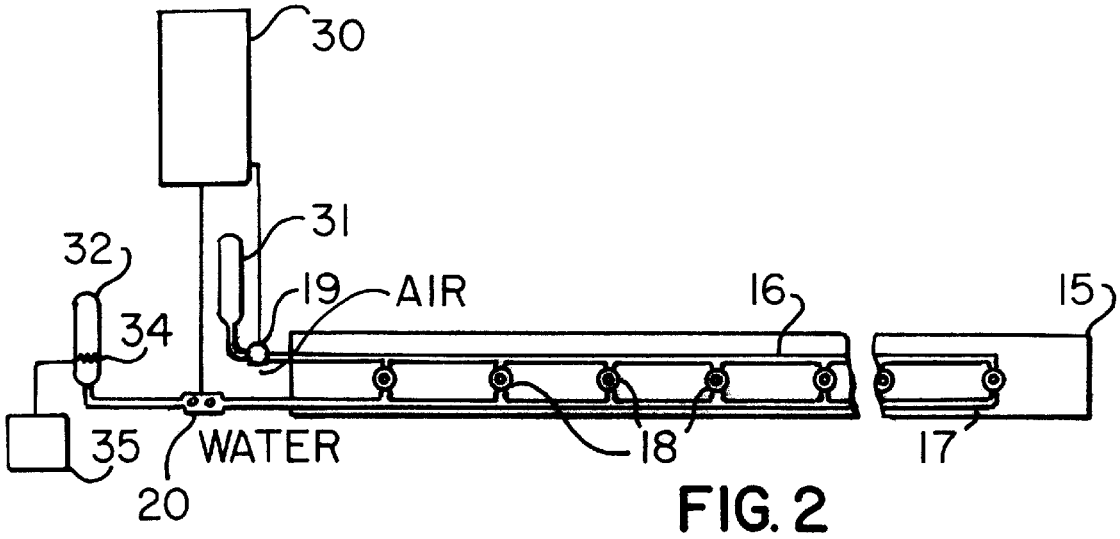
FIG. 2 is an illustration of the water spray valve atomizers array in accord with the present invention.

In FIG. 2, the frame 15 is to be sufficient in length to extend across a traveling web. Air line 16 and water line 17 provide inputs to spaced atomizing spray nozzles 18. Electric input control valves 19 (air) and 20 (water) are operated in accordance with electronic controller 30 to provide air from supply 31 and water from supply 32.

Figure 3:
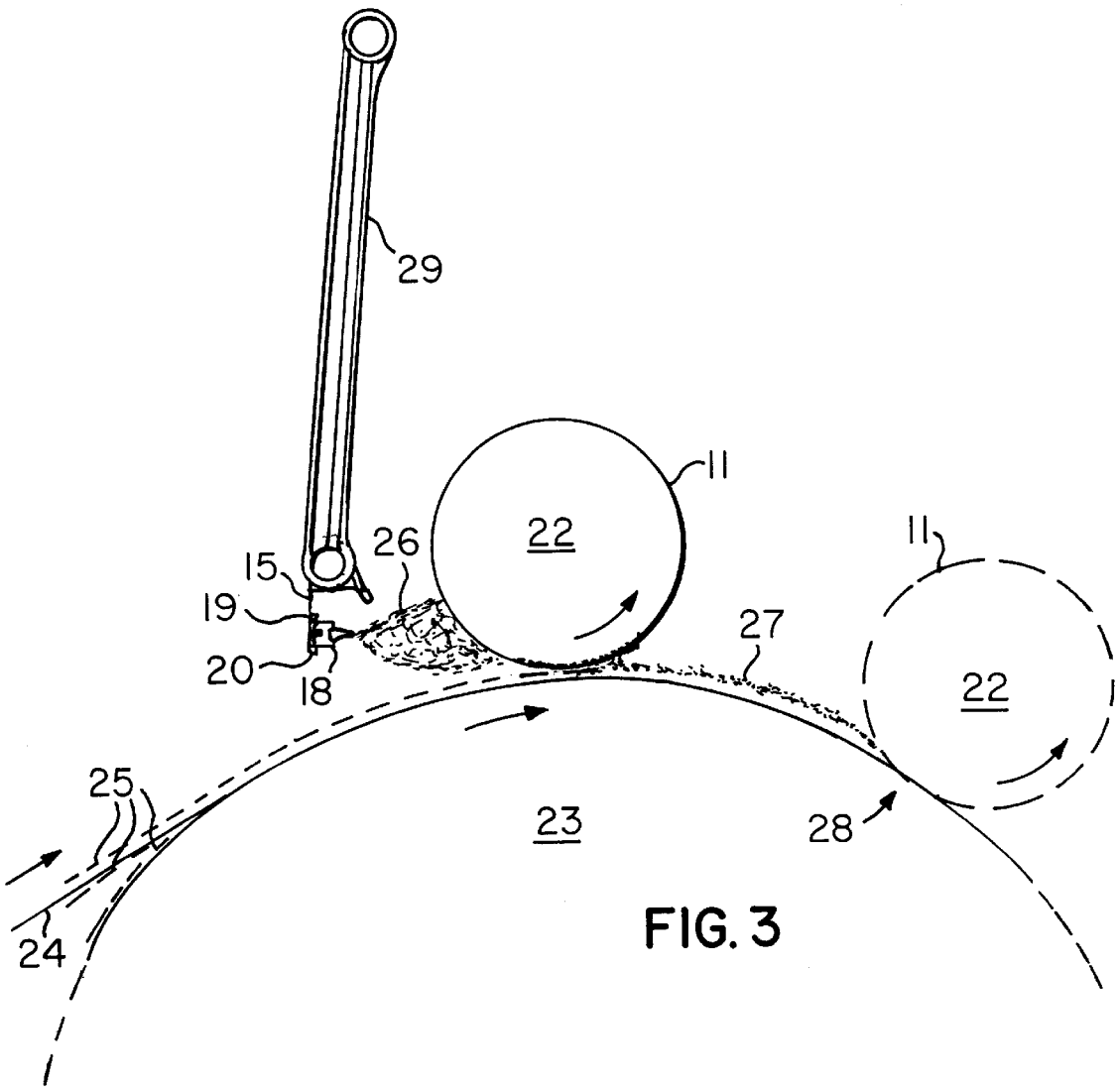
FIG. 3 is a pictorial illustration of the application of water from the array of FIG. 2.
Figure 4:
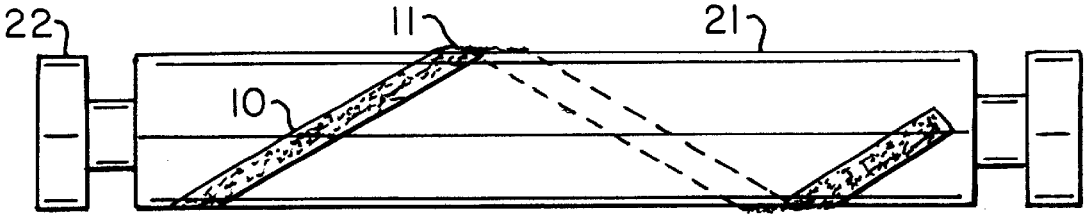
FIG. 4 is a pictorial illustration of the water-activated adhesive turn-up tape in accord with the present invention, attached to an empty paper reel.

FIG. 3 illustrates the operation of the apparatus. Surface 21 of empty reel 22 has tape 10 attached thereto (FIG. 4) in any appropriate manner. The present invention is directed to very light grades of paper such as tissue and the specific tape 10 attachment will depend on machine speed and other variables as understood in the art.

Shield 29 connects to frame 15 and the papermaking apparatus (not shown) and prevents web 24 from going backwards over frame 15 and into the input apparatus (not shown) in the event of web breakage or some other malfunction.

The number and spacing of the nozzles 18 depends on the spray pattern from each and the width of the web 24. Preferably, the nozzles 18 provide a spatially continuous wetting action of tape 10 across the entire web contact surface of reel 22.

Figure 5:
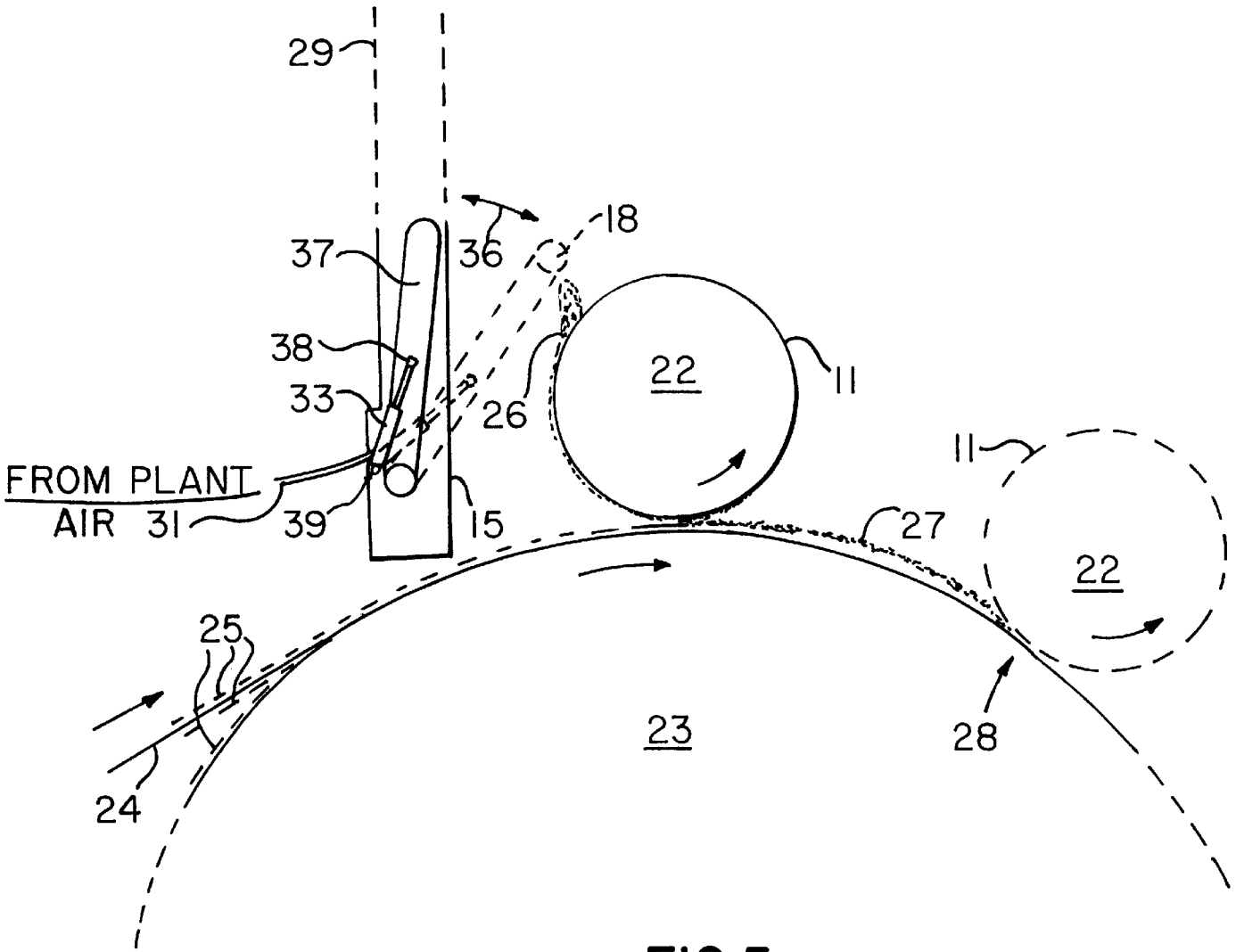
FIG. 5 is a pictorial illustration of an alternative embodiment of the water spray atomizers.
Figure 6:
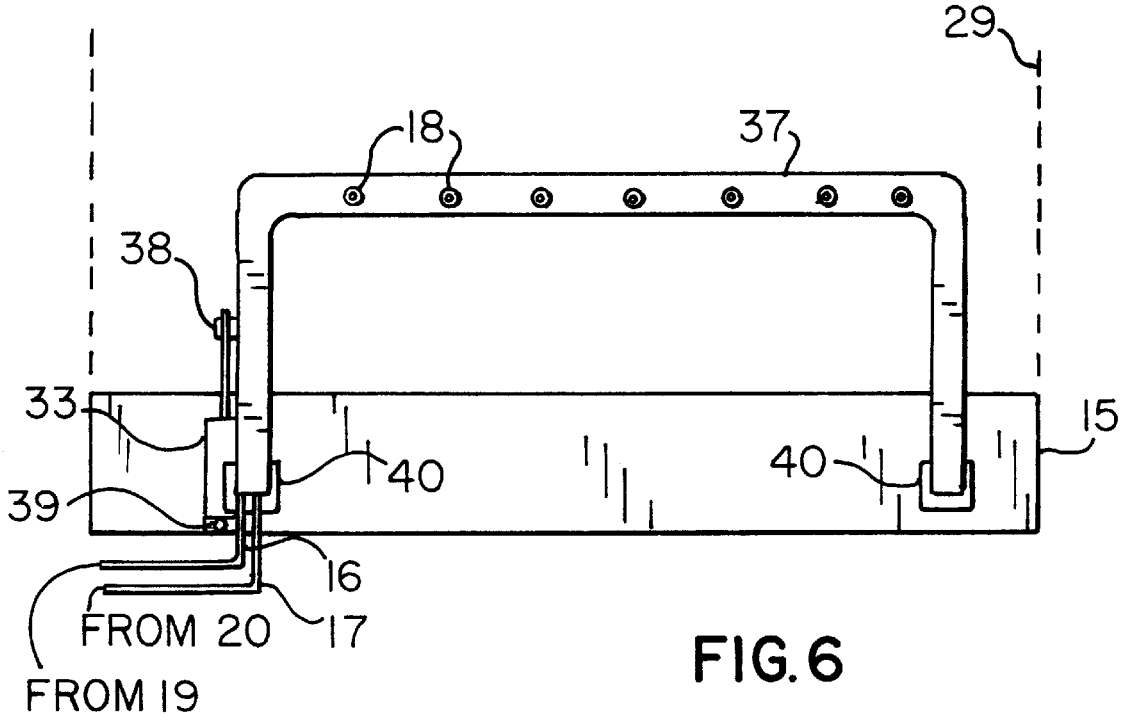
FIG. 6 is another view of the nozzles of FIG. 5.

In FIG. 5 an alternative embodiment of water spray atomizers where the nozzles 18 are mounted on a frame 37 pivotally mounted by brackets 40 and movable by cylinder 33 mounted via pins 38, 39 to allow the mist 26 can be moved as shown at arrow 36 closer to the surface of reel 22 for provide for quicker absorption of the water by the adhesive 11. In addition, the greater time during which water 26 is applied may be useful where, due to the high rpm of reel 22, water can be thrown off the adhesive 11 thus reducing the amount of water absorbed. The choice of the means used to apply water depends upon the various system parameters such as machine speed, the type of paper being turned up, etc.

Heater 34, powered by electric power supply 35 (FIG. 1), can be provided to supply an elevated water temperature or steam for enhanced wetting action where it may be desired. If such an alternative is used care need be taken to deal with condensation on the apparatus such as on and around the frame 15 and shield 29 as understood in the art.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. Apparatus for severing a traveling web of paper and transferring such severed web to an empty reel to which is attached a pressure sensitive adhesive carrying a strip of paper having a planar lower side substantially covered by said pressure sensitive adhesive and a planar upper side carrying a layer of water-activated adhesive covering substantially the entire surface of said upper side, said apparatus comprising a frame extending substantially a width of a web from one edge to another edge, selectively operable wetting means having water applying means mounted to said frame for selectively wetting said water-activated adhesive on said empty reel for attachment of such traveling web thereto and resulting in severing of such traveling web, said water applying means being located upstream from such empty reel and spaced above such traveling web for applying water onto a boundary layer of air above such traveling web.

2. The apparatus as defined in claim 1 wherein said wetting means includes a plurality of spaced nozzles and water supply means for selectively supplying water to each said nozzle.

3. The apparatus as defined in claim 2 wherein said water applying means further includes high pressure air supply means for supplying air to each said nozzle for providing an atomized spray of water from each said nozzle.

4. The apparatus as defined in claim 1 wherein said wetting means includes steam applying means having a plurality of spaced nozzles and steam supply means for selectively supplying steam to each said nozzle.

5. The apparatus as defined in claim 1 wherein said wetting means includes a plurality of nozzles and misting means for providing a water mist onto a boundary layer of air moving on an upper surface of such traveling web.

6. The apparatus as defined in claim 5 wherein said misting means includes water supply means for supplying water to each said nozzle and high pressure air means for supplying high pressure air to each said nozzle.

7. The apparatus as defined in claim 1 wherein said wetting means includes means for elevating the temperature of water applied from said water applying means.

8. Apparatus for severing a traveling web of paper and transferring such severed web to an empty reel comprising a strip of paper having a planar upper side carrying a layer of water-activated adhesive for adhering to a traveling web covering substantially the entire surface of said upper side, means for attaching said paper strip to an empty reel, said means for attaching covering substantially the entire surface of said paper strip, a frame, and selectively operable water applying means mounted to said frame for selectively wetting said water-activated adhesive attached to an empty reel for securing a traveling web thereto and severing of such web, said water-applying means being located upstream from such empty reel above a top surface of such traveling web for applying water onto a boundary layer of air located above such top surface of such traveling web.

9. The apparatus as defined in claim 8 wherein said means for attaching said water-activated adhesive includes pressure sensitive adhesive underlying said paper strip.

10. The apparatus as defined in claim 9 wherein said water applying means further includes a plurality of nozzles and high pressure air supply means for supplying air to each said nozzle for providing an atomized spray of water from each said nozzle.

11. The apparatus as defined in claim 8 wherein said water applying means includes misting means for providing a water mist onto a boundary layer of air moving on an upper surface of such traveling web for directing water into a nip between an empty reel and a reel drum for wetting said water-activated adhesive on an empty reel.

12. The apparatus as defined in claim 11 wherein said misting means includes a plurality of spaced atomizing nozzles located generally between side edges of such traveling web.

13. The apparatus as defined in claim 12 wherein said misting means includes water-supply means for supplying water to each said nozzle and high-pressure air means for supplying high-pressure air to each said nozzle.

14. A method for severing a traveling web of paper and transferring such severed web to an empty reel comprising the steps of:

A. attaching a paper sheet strip via a pressure sensitive adhesive to an empty spool in which the strip on its upper surface carries an exposed water-activated adhesive substantially throughout the upper surface;

B. mounting a plurality of spaced water-supplying nozzles generally between one edge of such traveling web to another edge; and C. selectively supplying water to each nozzle mounted in step B for wetting the water-activated adhesive of step A by applying water onto a boundary layer of air above such traveling web of paper.

15. The method of claim 14 wherein step C includes the step of:

D. applying a water mist onto a boundary layer of air moving on an upper surface of such traveling web prior to creating a nip between an empty reel and a reel drum.

16. Apparatus for severing a traveling web of paper and transferring such severed web to an empty reel comprising a quantity of composite tape including a sheet of paper having a planar upper side and a planar lower side, a layer of water-activated adhesive covering substantially said upper side, a layer of pressure sensitive adhesive covering substantially said lower side, and a releasable liner covering said pressure sensitive adhesive, a frame extending substantially the width of a traveling web from one edge to another edge, selectively operable water applying means mounted to said frame for wetting said layer of water-activated adhesive when a length of said tape is attached to an empty reel by said layer of pressure sensitive adhesive to permit securing of such traveling web to said water-activated adhesive, said water applying means being located upstream from such empty reel and spaced above such traveling web for applying water onto a boundary layer of air above such traveling web and moving at synchronous speed with such traveling web.

17. The apparatus as defined in claim 16 wherein said water applying means includes a plurality of spaced spray nozzles and water supply means for selectively supplying water to each said spray nozzle.

18. The apparatus as defined in claim 17 wherein said water supplying means further includes high pressure air supply means for supplying air to each said spray nozzle for providing an atomized spray of water from each said spray nozzle.

19. The apparatus as defined in claim 17 wherein said plurality of spaced spray nozzles is located across a web from one edge to another edge for wetting substantially an entire surface of said layer of water-activated adhesive.

20. The apparatus as defined in claim 16 wherein said water applying means includes misting means for providing a water mist onto a boundary layer of air moving on the upper surface of such traveling web for wetting substantially and entire surface of said layer of water-activated adhesive.

21. The apparatus as defined in claim 20 wherein said misting means includes a plurality of spaced atomizing spray nozzles located on said frame and extending from one edge of such traveling web to another edge.

* * * * *